United States Patent [19]

Tengzelius et al.

[11] 4,126,452

[45] Nov. 21, 1978

[54] PHOSPHORUS CONTAINING STEEL POWDER AND A METHOD OF MANUFACTURING THE SAME

[75] Inventors: Jan R. Tengzelius, Viken; Lars-Erik Svensson, Hoganas, both of Sweden

[73] Assignee: Hoganas AB Fack, Höganäs, Sweden

[21] Appl. No.: 809,797

[22] Filed: Jun. 24, 1977

[30] Foreign Application Priority Data

Jun. 24, 1976 [SE] Sweden ..... 7607285

[51] Int. Cl.[2] ..... C22C 1/04

[52] U.S. Cl. ..... 75/251; 75/255

[58] Field of Search ..... 75/0.5 BA, 255, 251

[56] References Cited

U.S. PATENT DOCUMENTS 3,357,817 12/1967 Harnisch et al. ..... 75/0.5 BA 3,836,355 9/1974 Lindskog et al. ..... 75/0.5 BA

FOREIGN PATENT DOCUMENTS 1,155,918 6/1969 United Kingdom ..... 75/0.5 BA

*Primary Examiner*—W. Stallard

*Attorney, Agent, or Firm*—Eugene E. Renz, Jr.

[57] ABSTRACT

New phosphorus-containing steel powders for use in the manufacture of sintered components of high toughness are described which comprise steel powder substantially free of phosphorus and having good compressibility, and in intimate admixture therewith, a ferrophosphorus powder having a phosphorus content of at least about 2.8% by weight and preferably about 12 to 17%, in proportions to provide a phosphorus content in the final powder of from about 0.2 to 1.5% by weight, the ferrophosphorus powder containing at least about 0.3% carbon and preferably about 0.5 to 2.5% and having a maximum particle size of about 10 to 20 μm.

9 Claims, 1 Drawing Figure

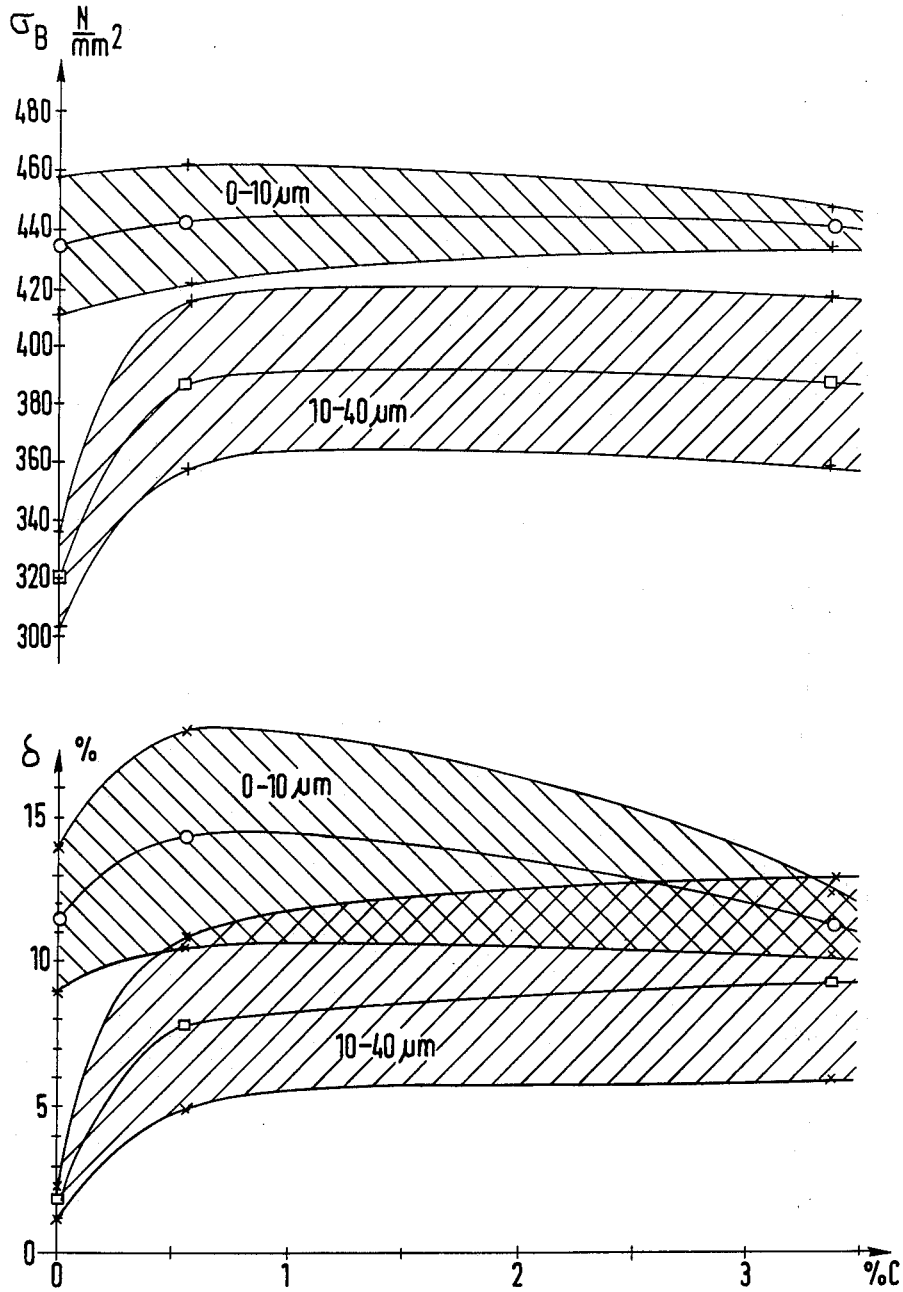
σB N/mm2
480
460
440
420
400
380
360
340
320
300
0-10 µm
10-40 µm
δ %
15
10
5
0
0-10 µm
10-40 µm
0
1
2
3
%C

PHOSPHORUS CONTAINING STEEL POWDER AND A METHOD OF MANUFACTURING THE SAME

The present invention relates to phosphorus-containing steel powder mixtures to be used in powder metallurgy. In addition to iron and phosphorus these powder mixtures can contain other alloying elements commonly used within this technique, such as copper, nickel, molybdenum, chromium and carbon.

The use of phosphorus as an alloying element in powder metallurgy has been known since 1940. Sintered steel alloyed with phosphorus has substantially improved strength as compared to unalloyed sintered steel. Mixtures of pure iron powder and ferrophosphorus powder have been used previously for this purpose. However, the ferrophosphorus first so-used had a composition which made it extremely hard and caused considerable wear of the compacting tools. This drawback has been reduced to an acceptable degree by using a ferrophosphorus powder having a lower content of phosphorus and thereby reduced hardness, see for example Lindskoz et al U.S. Pat. No. 3,836,355 issued Sept. 17, 1974.

However, sintered components manufactured by pressing and sintering such steel powder mixtures sometimes exhibit an unacceptable brittleness. This is evident for example from the fact that a population of sintered test bars made from a mixture of iron and ferrophosphorus powders can comprise individual test bars having extremely reduced mechanical characteristics especially with regard to impact strength and elongation at rupture. As the advantage of phosphorus alloyed sintered steels is high strength in combination with very good ductility the above-mentioned brittleness risks are very serious.

Said brittleness risk has been shown to exist when the ferrophosphorus has such a composition that a liquid phase is formed at the sintering temperature. At the sintering temperature normally used, i.e. 1040° C. and above, this means that phosphorus contents of more than 2.8% in the ferrophosphorus give a sintered material having an increased risk of brittleness. The fact that ferrophosphorus with a high phosphorus content is used in spite of this drawback is related to the favorable sintering conditions which result from the presence of the liquid phase. The liquid phase also means a favorable distribution of phosphorus with respect to a rapid diffusion of phosphorus into iron.

Thus, the object of the present invention is to solve said problems with regard to the brittleness of sintered steel manufactured from a mixture of iron powder and a ferrophosphorus powder having a phosphorus content exceeding 2.8%. The solution of the problem has been found to consist in the use of a ferrophosphorus powder having a certain carbon content. A further improvement is obtained if the ferrophosphorus powder also has a small maximum particle size.

A phosphorus-containing steel powder according to the invention to be used in the manufacture of sintered components having an extremely small tendency to brittle fracture consists of an iron or steel powder substantially free from phosphorus, mixed with a ferrophosphorus powder, wherein said ferrophosphorus powder has a carbon content exceeding 0.3%, preferably exceeding 0.5%. In a preferred embodiment of the phosphorus-containing steel powder the carbon content of the ferrophosphorus powder does not exceed 2.5%.

It is also preferred that the ferrophosphorus powder have a maximum particle size of 20 μm, preferably a maximum particle size of 10 μm. The phosphorus content of the ferrophosphorus powder shall exceed 2.8% and in order to reduce the wear of the compacting tools the phosphorus content shall be less than 17%. If the ferrophosphorus powder is manufactured by grinding, its phosphorus content shall exceed 12% and shall preferably be between 14 and 16%. The phosphorus content of the preferred final mixture is between 0,2 and 1,5%.

The great difference between the particle size of the different powder components in such a mixture leads to a particularly great risk of segregation or demixing, and thereby to an uneven distribution of the alloying elements. In order to reduce the tendency of the mixture to segregate after the mixing operation, 50–200 g of a light mineral oil per metric ton powder can be added during the mixing operation. Thereby the fine alloying particles are made to adhere to the coarser iron powder particles.

In order to provide a further improvement of the protection against segregation of the iron-ferrophosphorus powder mixture with or without the addition of oil it is heated in a reducing atmosphere to a temperature of between 650° and 900° C. for a period of 15 minutes to 2 hours. Thereby, the powder is loosely sintered together so that a subsequent cautious disintegration may to be carried out to restore the original particle size. The powder obtained in this way has particles of the fine grained ferrophosphorus powder sintered onto the iron particles.

The methods described above in order to avoid segregation can be performed on a mixture having an increased content of the ferrophosphorus-containing powder. The concentrate thus obtained can be mixed with iron powder to provide for the desired phosphorus content in the final product.

The carbon content range which is preferred according to the invention clearly appears from the following example.

EXAMPLE

Three melts of iron-phosphorus containing 16% phosphorus and controlled carbon contents of 0.007, 0.55 and 3.37%, respectively, and additional impurity contents of 0.01% were manufactured and were allowed to solidify. Thereupon, they were ground to a powder, from which two size classes were taken, i.e. 0–10 μm and 10–40 μm. These phosphorus-containing powders were mixed with extremely pure iron powder having a maximum particle size of 150 μm so that the mixture obtained had a phosphorus content of 0.6%, whereupon the mixture was pressed to tensile test bars according to MPIF Standard 10–63. Thereupon the bars were sintered in cracked ammonia at 1120° C. for 1 hour. Tensile strength and elongation were determined, and the results plotted in the curves in the accompanying drawing, wherein the values relate to the mean value including the standard deviation for 7 bars.

The curves show that the tensile strength as well as the elongation increase when the ferrophosphorus powder has an increased carbon content. The values relating to sintered material containing a ferrophosphorus powder which is free from carbon and has a particle size of 10–40 μm indicate a brittle fracture behavior for this material whereas a content of 0.3% of carbon in the ferrophosphorus powder provides for substantially enhanced values indicating a tough fracture behavior.

Also for the fraction of the ferrophosphorus powder having the small particle size there is provided an improvement of the properties measured according to the above statements. In order to obtain the most advantageous material the carbon content of the ferrophosphorus powder shall, however, exceed 0.5%. However, if the carbon content is increased too much, the example shows that the elongation has a tendency of being reduced again for which reason the carbon content of the ferrophosphorus should be less than 2.5%.

We claim:

1. In a phosphorus-containing steel powder for use in the manufacture of sintered components of high toughness comprising steel powder substantially free of phosphorus and having good compressibility and in intimate admixture therewith a ferrophosphorus powder having a phosphorus content of at least about 2.8% by weight in proportions to provide a phosphorus content of from about 0.2 to about 1.5% by weight of the phosphorus-containing steel powder, the improvement which comprises:

said ferrophosphorus powder having a carbon content exceeding about 0.3% by weight whereby said phosphorus-containing steel powder when sintered produces components of high toughness with reduced risk of brittleness.

2. A phosphorus containing steel powder according to claim 1 wherein the ferrophosphorus powder contains from about 12 to about 17% phosphorus by weight and the carbon content of the phosphorus-containing steel powder is from about 0.5% to about 2.5%.

3. A phosphorus-containing steel powder according to claim 2 wherein the total content of impurities in the carbon-containing ferrophosphorus powder which are more easily oxidized than iron is less than about 4% by weight.

4. A phosphorus-containing steel powder according to claim 1 wherein the ferrophosphorus powder has a maximum particle size of about 10 to 20 μm.

5. A phosphorus containing steel powder according to claim 3 wherein the ferrophosphorus powder has a maximum particle size of about 10 to 20 μm.

6. A phosphorus-containing steel powder according to claim 1 wherein the ferrophosphorus particles are substantially adhered by sintering to the steel powder particles thus obviating segregation of the steel and ferrophosphorus particles in the mixture.

7. A phosphorus-containing steel powder according to claim 1 wherein the ferrophosphorus particles are adhered to the steel particles by the intimate admixture therewith of about 0.005 to about 0.02% by weight of the total mixture of liquid mineral oil.

8. A method for making a phosphorus-containing steel powder according to claim 1 wherein said ferrophosphorus powder is first mixed with a portion of said steel powder to form a concentrate, said concentrate is sintered, the resulting sinter is disintegrated, and the resulting particulate concentrate is mixed with the remainder of the steel powder to produce said phosphorus-containing steel powder.

9. A method according to claim 8 wherein about 0.005 to about 0.02% by weight of the total composition of mineral oil is admixed with said concentrate before sintering.

* * * * *